US009737102B1

(12) United States Patent
Sinclair

(10) Patent No.: US 9,737,102 B1
(45) Date of Patent: Aug. 22, 2017

(54) TEXTILE FASTENER

(71) Applicant: Margaret A. Sinclair, Dallas, TX (US)

(72) Inventor: Margaret A. Sinclair, Dallas, TX (US)

( * ) Notice: Subject to any disclaimer, the term of this patent is extended or adjusted under 35 U.S.C. 154(b) by 0 days.

(21) Appl. No.: 15/290,034

(22) Filed: Oct. 11, 2016

Related U.S. Application Data

(63) Continuation-in-part of application No. 14/738,996, filed on Jun. 15, 2015, now Pat. No. 9,489,873, which is a continuation-in-part of application No. 13/724,044, filed on Dec. 21, 2012, now Pat. No. 9,320,328.

(51) Int. Cl.

| | |
|---|---|
| ***A41F 1/00*** | (2006.01) |
| ***A44C 3/00*** | (2006.01) |
| ***A41D 23/00*** | (2006.01) |
| ***G09F 3/06*** | (2006.01) |
| ***A44C 1/00*** | (2006.01) |

(52) U.S. Cl.
CPC ..... *A41F 1/002* (2013.01); *A41D 23/00* (2013.01); *A44C 1/00* (2013.01); *A44C 3/001* (2013.01); *G09F 3/06* (2013.01); *A44D 2203/00* (2013.01); *Y10T 24/32* (2015.01); *Y10T 24/44034* (2015.01)

(58) Field of Classification Search
CPC A44C 1/00; A44C 3/001; Y10T 24/32; Y10T 24/44034; G09F 3/06; A44D 2203/00; A41D 23/00; A41F 1/002
See application file for complete search history.

(56) References Cited

U.S. PATENT DOCUMENTS 2,435,082 A * 1/1948 Huber ..... A47C 21/022 210/479
2,454,103 A * 11/1948 Swidersky ..... A44B 99/00 24/113 MP
2,939,195 A * 6/1960 Carlson ..... F16B 2/248 24/459
3,141,216 A * 7/1964 Haskell ..... A41F 1/002 24/303
3,865,290 A * 2/1975 Sperling ..... A63B 47/001 224/194
4,175,305 A * 11/1979 Gillis ..... E04H 15/32 135/119
4,688,304 A * 8/1987 Marcott ..... A47K 10/12 135/119
5,033,170 A * 7/1991 Ewert ..... A41F 1/00 24/459
5,369,899 A * 12/1994 Reeves ..... A44C 3/001 24/303

(Continued)

*Primary Examiner* — Robert J Sandy
*Assistant Examiner* — Louis Mercado
(74) *Attorney, Agent, or Firm* — Fogarty LLP

(57) ABSTRACT

Magnetic textile fasteners are disclosed. In one embodiment, the textile fastener may include a spherical member and two receiving members. Each of the receiving members may include a surface portion and an opening within the flat surface portion, wherein the opening is configured to receive the spherical member. In an embodiment, textiles are placed between each receiving portion and the spherical member while the spherical member is inserted at least partially into the openings. The spherical member thereby applies a force between each textile and its respective receiving member. Magnetic interaction between the spherical member and the receiving members may maintain the force between the textile and the receiving members.

18 Claims, 8 Drawing Sheets

(56) References Cited

U.S. PATENT DOCUMENTS

| | | | | |
|---|---|---|---|---|
| 5,511,289 | A * | 4/1996 | Melia | A44B 6/00 24/459 |
| 8,347,416 | B1 * | 1/2013 | Query | A41F 1/00 2/244 |
| 8,650,725 | B1 * | 2/2014 | Cooper | E04H 15/64 135/119 |
| 2007/0251062 | A1 * | 11/2007 | Saitoh | E05B 73/0035 24/303 |
| 2013/0247279 | A1 * | 9/2013 | Castillo | A44B 3/08 2/255 |
| 2013/0269156 | A1 * | 10/2013 | Fildan | A41F 1/002 24/303 |

* cited by examiner

TEXTILE FASTENER

CROSS-REFERENCE TO RELATED APPLICATION

This application is a continuation-in-part of, and claims priority to, U.S. patent application Ser. No. 14/738,996, now U.S. Pat. No. 9,489,873 also entitled "Textile Fastener", filed Jun. 15, 2015, which is a continuation-in-part of U.S. patent application Ser. No. 13/724,044, now U.S. Pat. No. 9,320,328 also entitled "Textile Fastener", filed Dec. 21, 2012, the disclosures of which are hereby incorporated herein by reference.

TECHNICAL FIELD

Embodiments of the invention are directed, in general, to fasteners and, more specifically, to magnetic textile fasteners.

BACKGROUND

Textiles include cloth or fabric which may be used for various purposes including manufacture of clothing, window coverings, furniture coverings, towels, bed sheets, and many others. Textiles are often made by weaving, knitting, crocheting, knotting or pressing natural or artificial fibers together. Textiles can be made from any number of materials, in a variety of colors, by a variety of techniques, and for a variety of purposes.

Clothing is one of the primary uses of textiles. Tailors and dressmakers use textile fabric to make fine dresses and suits. Clothing manufacturers use textile fabric to mass produce shirts, trousers, dresses, and the like. Additionally, simple strips of textile fabric may be used to make scarfs, sarongs, wraps, skirts, shawls, and the like.

Additionally, textiles may be adorned with various ornaments or accessories to enhance the appearance of the textile. For example, ornamental flowers or brooches may be attached to the textile to improve its appearance or add design elements to finished products. Typically, such ornaments are sewn or pinned in place.

SUMMARY

A multi-purpose no-sew textile fastener will hold multiple layers of fabric together without damage. Double rings are combined with a powerful ball magnet and can be used over and over again for many purposes, including household and outdoors projects and men's and women's fashions.

Embodiments of the invention are directed to textile fasteners. In some embodiments, a textile fastener may be fastened to a textile layer without damaging the textile. For example, the textile fastener does not require penetration the surface or disruption of the weave of the textile with a pin or needle. In certain embodiments, a cover member of the textile fastener includes an ornamental and/or functional component.

In one embodiment, the textile fastener may include a spherical member, a receiving member and a cover member. The receiving member may include a flange portion and an opening extending through the flange portion, wherein the opening is circular and has an inner diameter that is larger than the spherical member's diameter. The opening receives the textile and the single spherical member so that the single spherical member applies a friction force between the textile and the receiving member when the single spherical member is inserted into the opening. The magnetic interaction between the single spherical member and the receiving member maintains at least a portion of the friction force between the textile and the receiving member. The cover member may include an outer assembly and an inner assembly joined to the outer assembly, wherein the inner assembly couples the cover member to the spherical member via magnetic interaction between the inner assembly and the spherical member.

In one embodiment, the inner portion of the cover member includes a dome-shaped indentation that is adapted to receive the spherical member. The dome-shaped indentation having a diameter that is greater than the diameter of the spherical member.

In a further embodiment, the outer diameter of the cover member is larger than the outer diameter of the receiving member. In a further embodiment, the outer assembly of the cover member comprises an ornamental structure. In a further embodiment, the outer assembly is comprised of a non-magnetic material. In a further embodiment, the cover member comprises an identification badge. In a further embodiment, the cover member conceals the single spherical member and the receiving member.

Another embodiment comprises a single sphere and two retaining members. A textile fastener comprises a single spherical member having a spherical diameter, wherein the single spherical member is comprised of a magnetic material. The textile fastener further comprises a first receiving member. The first receiving member comprises a first ring portion, and a first opening extending through the first ring portion. The first opening is circular and has a first inner diameter that is smaller than the spherical diameter. The first opening receives a first textile and the single spherical member so that the single spherical member applies a force between the first textile and the first receiving member. Magnetic interaction between the single spherical member and the first receiving member maintains at least a portion of the force between the first textile and the first receiving member. The textile fastener further comprises a second receiving member comprising a second ring portion, and a second opening extending through the second ring portion. The second opening is circular and has a second inner diameter that is smaller than the spherical diameter. The second opening receives a second textile and the single spherical member so that the single spherical member applies a force to hold the second receiving member against the textile. Magnetic interaction between the single spherical member and the second receiving member maintains at least a portion of the force between the second textile and the second receiving member.

In another embodiment, a textile fastener comprises a single spherical member having a spherical diameter and two receiving members. A first receiving member comprises a first surface portion, and a first opening. The first opening is circular and has a first inner diameter that is larger than the spherical diameter. The first opening receives a first textile and the single spherical member so that the single spherical member applies a force against the first textile and the first receiving member when the single spherical member is inserted into the first opening thereby inhibiting movement of the first textile relative to the single spherical member. Magnetic interaction between the single spherical member and the first receiving member maintains at least a portion of the force between the first textile and the first receiving member. A second receiving member comprises a second surface portion, and a second opening. The second opening is circular and has a second inner diameter that is larger than the spherical diameter. The second opening receives a second textile and the single spherical member so that the single spherical member applies a force against the second textile and the second receiving member when the single spherical member is inserted into the second opening thereby inhibiting movement of the second textile relative to the single spherical member. Magnetic interaction between the single spherical member and the second receiving member maintains at least a portion of the force between the second textile and the second receiving member.

The first textile and the second textile may be different sections of the same article. The first textile and the second textile may comprise different articles. At least one of the first and second textiles may comprise multiple layers of materials. The first receiving member may comprise an ornamental structure. One or both of the receiving members may be magnetic or non-magnetic. The single spherical member may be magnetic or non-magnetic. One or both of the first receiving member and the second receiving member may be disk-shaped, hoop-shaped, or ring-shaped.

BRIEF DESCRIPTION OF THE DRAWINGS

Figure 1:
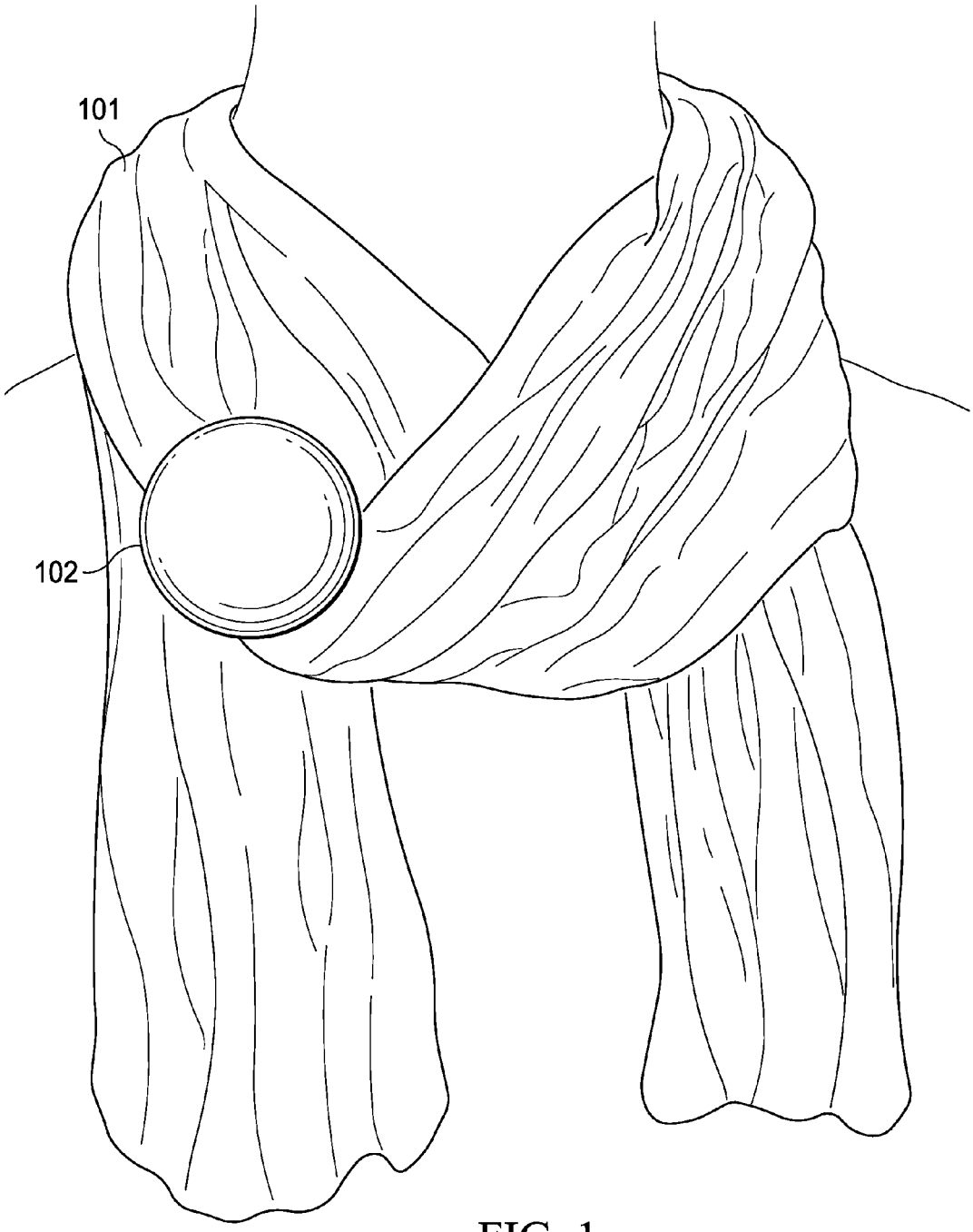

Having thus described the invention in general terms, reference will now be made to the accompanying drawings, which are not necessarily drawn to scale, and wherein:

FIG. 1 is an illustration of a textile with a textile fastener with an ornamental cover member.

Figure 2:
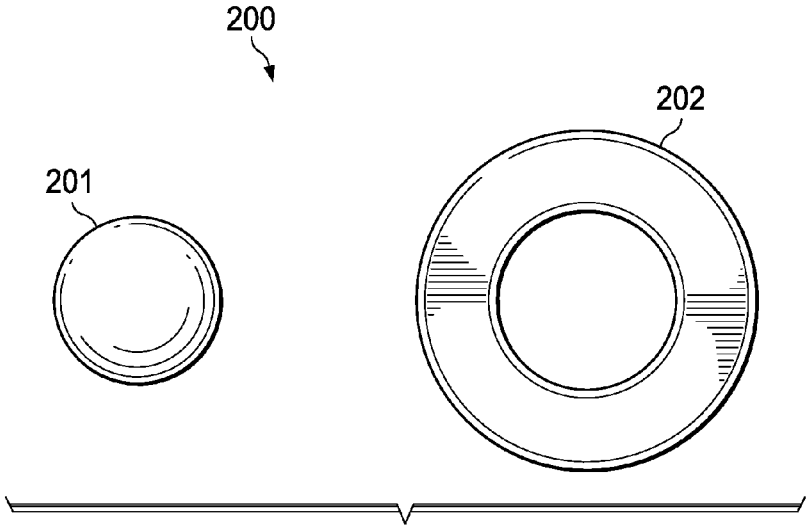

FIG. 2 is a top view diagram illustrating one embodiment of a spherical member and receiving member of a textile fastener.

Figure 3:
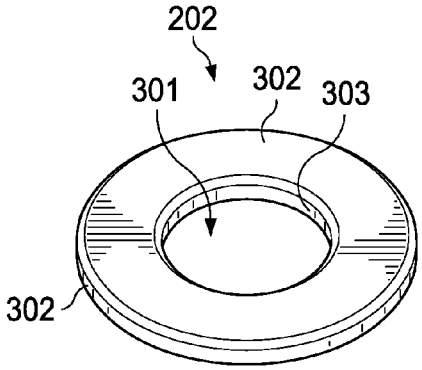

FIG. 3 is a perspective view diagram illustrating one embodiment of a receiving member.

Figure 4:
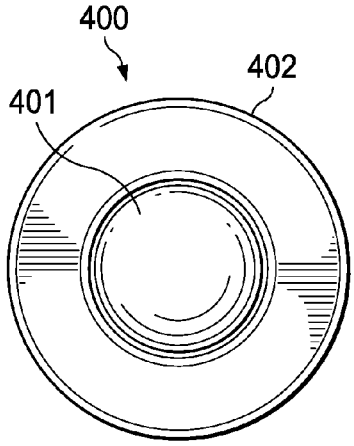

FIG. 4 is a top view diagram illustrating one embodiment of a spherical member and receiving member of a textile fastener in a pegged configuration.

Figure 5:
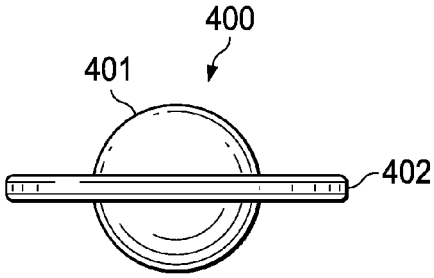

FIG. 5 is a side view diagram illustrating one embodiment of a spherical member and receiving member of a textile fastener in a pegged configuration.

Figure 6:
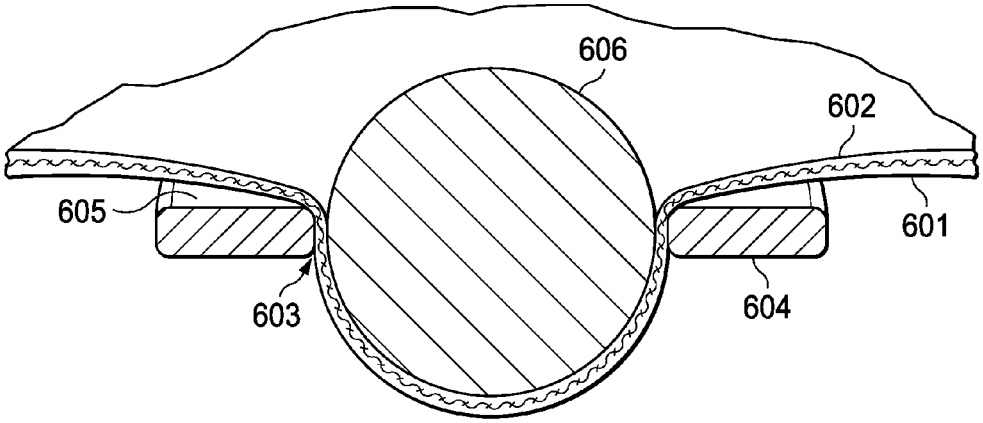

FIG. 6 is a cross-section view diagram illustrating one embodiment of a spherical member and receiving member of a textile fastener configured to fasten to a textile.

Figure 7:
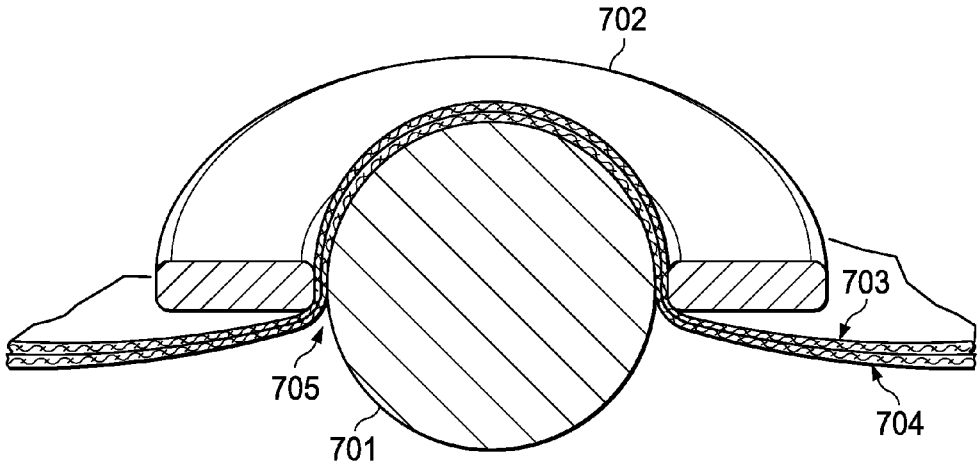

FIG. 7 is a cross-section view diagram illustrating one embodiment of a spherical member and receiving member of a textile fastener configured to fasten multiple textile layers.

Figure 8:
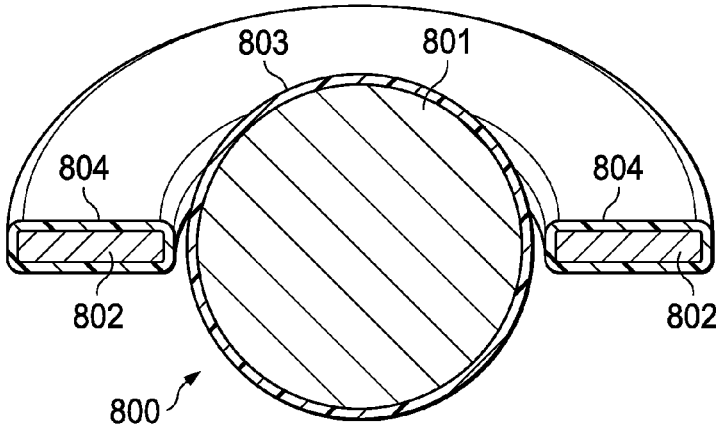

FIG. 8 is a cross-section view illustrating a spherical member and a receiving member of one embodiment of a textile fastener having a protective coating.

Figure 9:
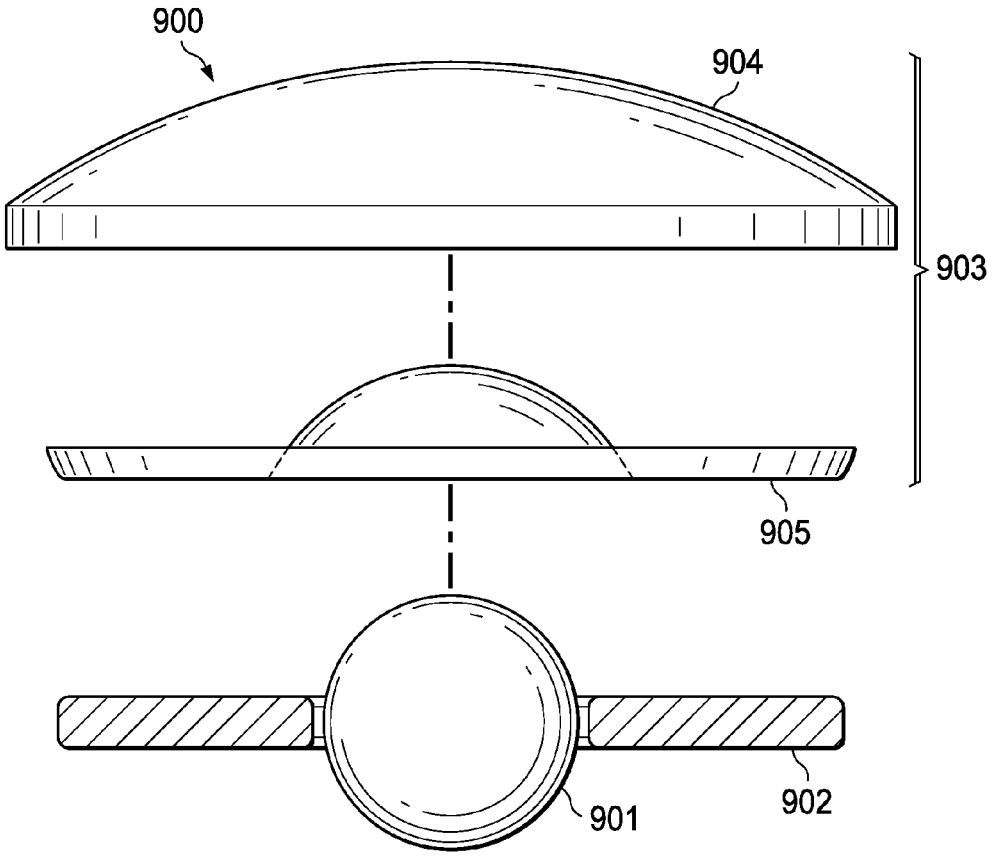

FIG. 9 is a cross-section diagram illustrating an embodiment of a textile fastener including a spherical member, a receiving member, and a cover member having an outer assembly joined with an inner assembly.

Figure 10:
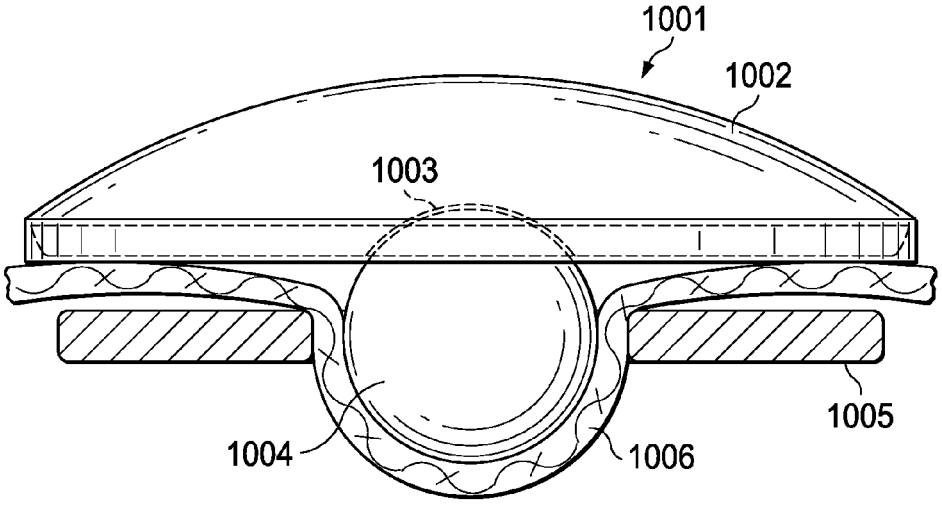

FIG. 10 is a cross-section view of an embodiment of a textile fastener having a cover member comprised of a joined outer assembly and inner assembly.

Figure 11:
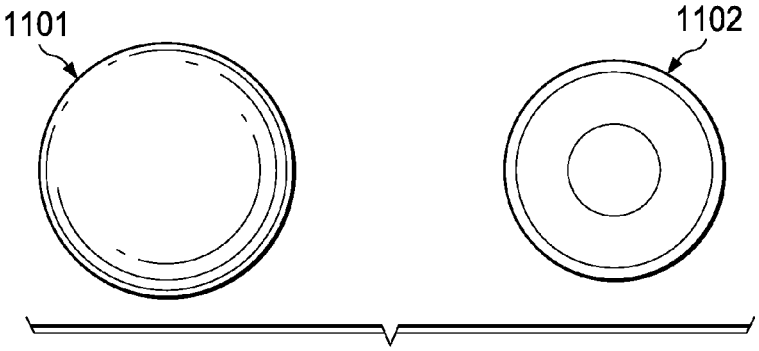

FIG. 11 illustrates top and bottom views of the textile fastener.

Figure 12:
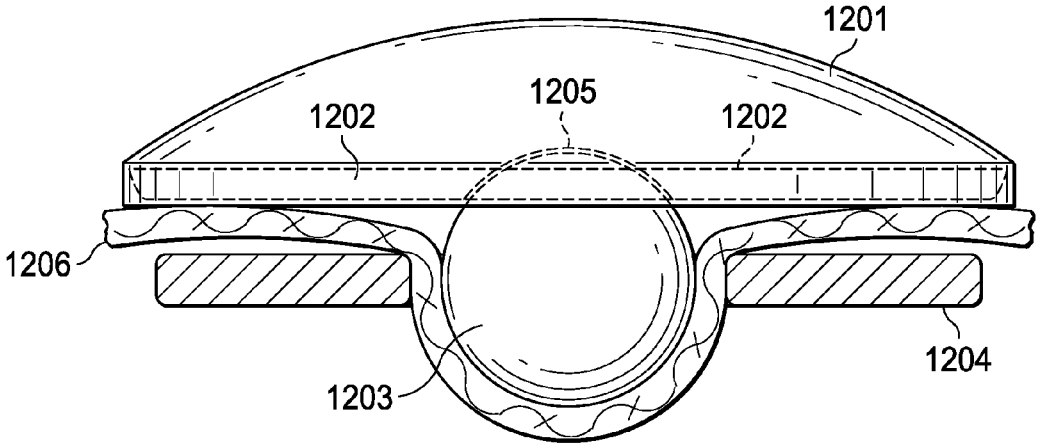

FIG. 12 illustrates another embodiment of a textile fastener that is configured to provide an improved mating between the inner assembly of a cover member and the spherical member.

Figure 13:
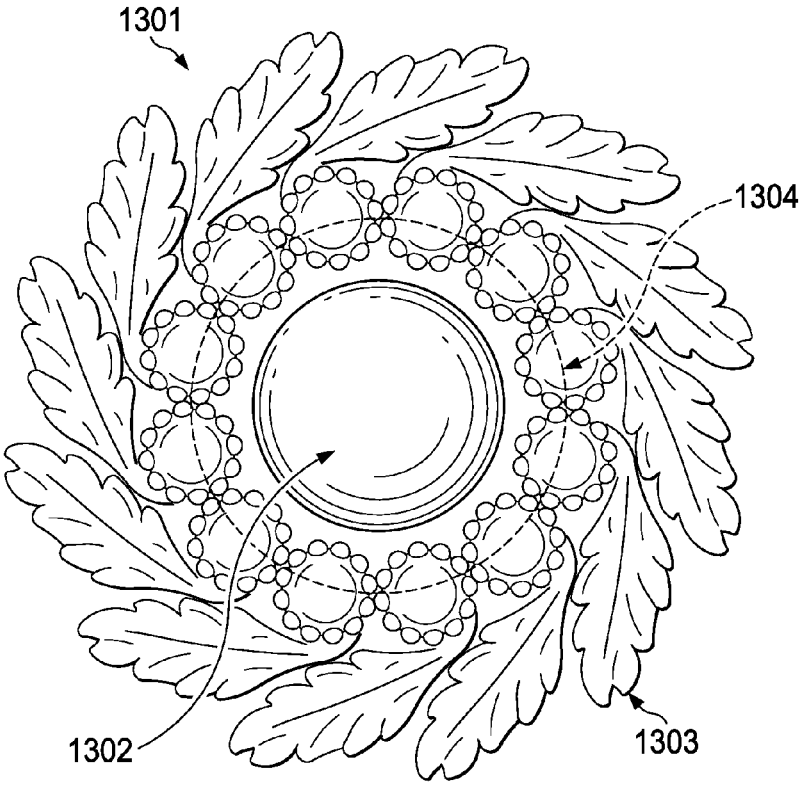

FIG. 13 illustrates an embodiment of a textile fastener with a decorative component of the outer assembly.

Figure 14:
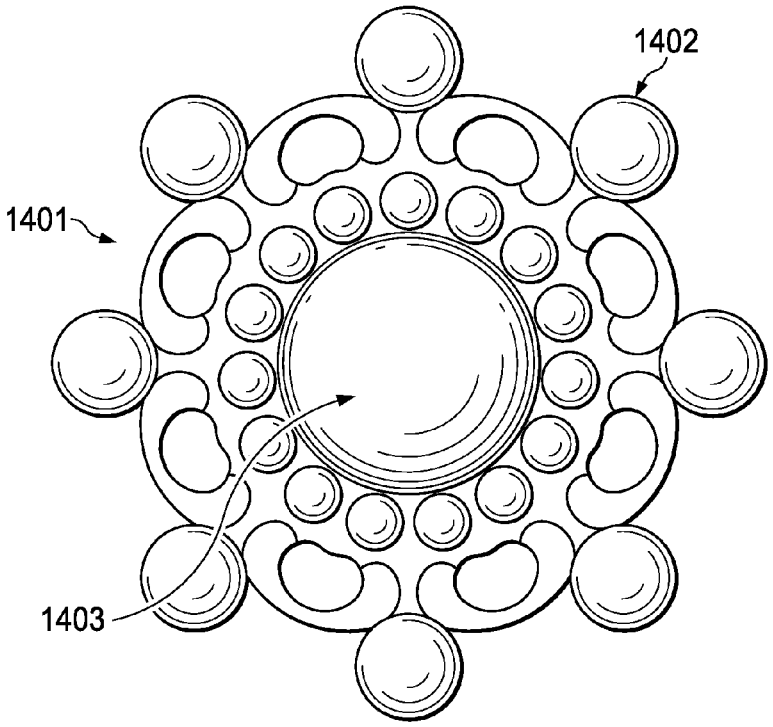

FIG. 14 illustrates another embodiment of a textile fastener with a different decorative component of the outer assembly.

Figure 15:
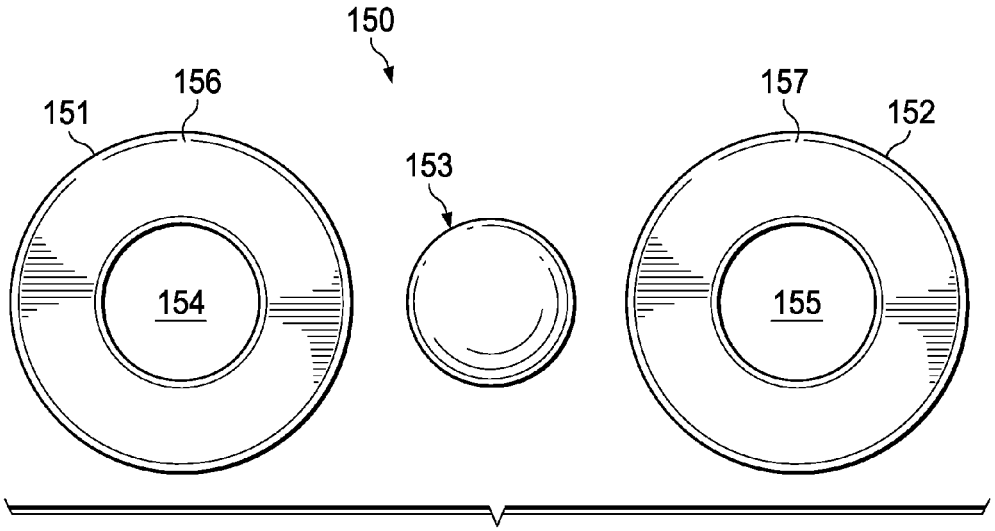

FIG. 15 illustrates components of an embodiment of a textile fastener having multiple receiving members.

Figure 16:
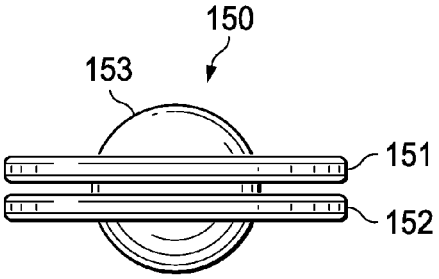

FIG. 16 illustrates an embodiment of a textile fastener having multiple receiving members.

Figure 17:
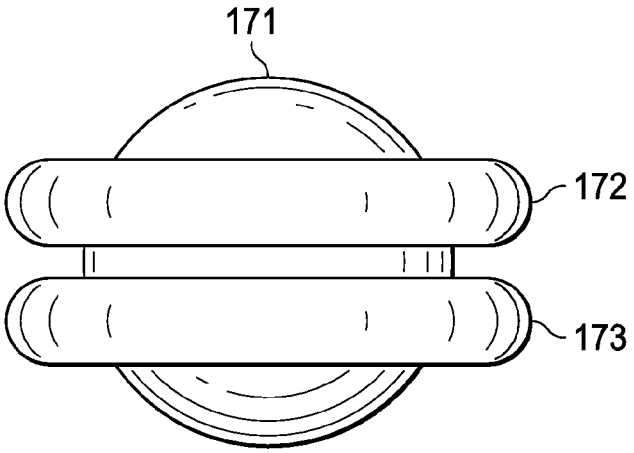

FIG. 17 illustrates an alternative embodiment of a textile fastener having multiple receiving members.

Figure 18:
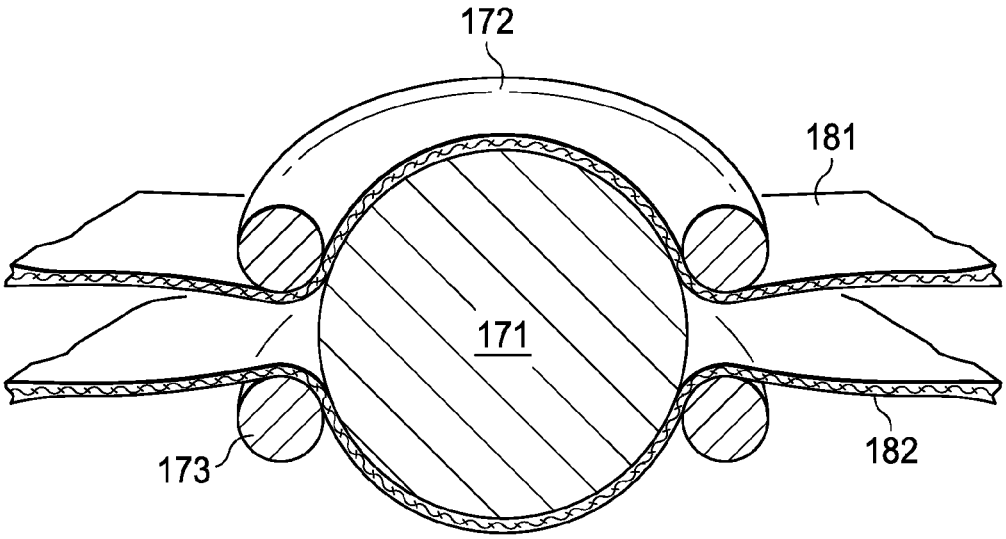

FIG. 18 is a cross-section view illustrating one embodiment of a textile fastener having multiple receiving members that are configured to fasten multiple textile layers.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

FIG. 1 is an illustration of a textile 101 with a textile fastener 102 having an ornamental cover. As illustrated, the textile 101 may be a scarf. In other embodiments, the textile 101 may be a cloth, wrap, shirt, dress, skirt, sarong, or any number of other articles of clothing. In other embodiments, the textile may be a window covering, a furniture covering, a towel, or any of a variety of other textiles 101. The textile may be made by weaving, knitting, crocheting, knotting or pressing natural or artificial fibers together. In a further embodiment, the term textile may be extended to include latex, vinyl, leather, canvas, plastic, paper, fur, and other sheets of material. Various embodiments of the textile fastener with an ornamental cover 102 are discussed in the figures that follow.

FIG. 2 is a top view diagram illustrating a spherical member 201 and a receiving member 202 in one embodiment of a textile fastener 200. In one embodiment, the spherical member 201 is made from a magnetic material, and the receiving member 202 is made from a ferromagnetic material. In another embodiment, the receiving member 202 is made from a magnetic material, and the spherical member is made from a ferromagnetic material. In further embodiments, both the receiving member 202 and the spherical member 201 are made from magnetic materials.

In embodiments where only one of the spherical member 201 or the receiving member 202 is magnetic, the non-magnetic member comprises a magnetically reactive material, such as iron or other ferrous material. For example, if only the spherical member 201 is magnetic, the receiving member 202 may have a non-magnetic steel or iron component that is reactive to magnetic fields. If only the receiving member 202 is magnetic, then the spherical member 201 is reactive to magnetic fields. One of ordinary skill in the art will recognize a variety of magnetic materials that may be suitable for use with the present embodiments. In one embodiment, strong permanent magnets made from alloys of rare earth elements are used. Similarly, one of ordinary skill in the art will recognize a variety of materials that are reactive to magnetic fields that may be suitable for use with the present embodiments.

The receiving member 202 and the spherical member 201 may each be configured in various shapes and arrangements. For example, the receiving member 202 may have a disk shape as illustrated in FIG. 3. The receiving member 202 may include an opening 301 in the disk. The opening 301 may be a hole through the surface 302 of the disk. Alternatively, in some embodiments, the opening 301 may be a concave recess in the surface 302 of the disk. The spherical member 201 may be a sphere configured to fit through the opening 304. In a particular embodiment, the diameter of the spherical member 201 may be slightly smaller than the diameter of the opening 301, thus allowing space for one or more layers of textile 200 to be pinched and held in place between an inner edge 303 of the opening 301 and a surface of the spherical member 201.

In the embodiment shown in FIG. 3, the receiving member 202 includes an inner edge 303 and an outer edge 304, wherein the inner edge 303 defines the opening 301. In such an embodiment, the inner edge 303 and the outer edge 304 may be concentric circles. One of ordinary skill in the art may recognize alternative geometries which may be suitable for use with the present embodiments. For example, the opening 301 may be rectangular, square, octagonal, hexagonal, oval, or the like. Thus, the opening 301 may be configured to receive a spherical member having various cross-section geometries. Furthermore, inner edge 303 and outer edge 304 may create different shapes. For example, inner edge 303 may form a circular opening 301, while outer edge 304 creates a rectangular, square, octagonal, hexagonal, oval, or other non-circular shape.

FIG. 4 is a top view illustrating one embodiment of a textile fastener 400 wherein the spherical member 401 and receiving member 402 are in a "pegged" configuration. As illustrated, the spherical member 401 may be inserted into the opening of the receiving member 402. In the illustrated embodiment, the receiving member 402 is disk shaped and the spherical member 401 is spherical or ball shaped; however, it will be understood that any number of other shapes may also be used.

In a further embodiment, the spherical member 401 may be magnetic. For example, the spherical member 401 may be a magnet made from rare earth alloys. The magnet may be formed in a spherical shape. In another embodiment, the magnet may be formed in a cylindrical shape. One of ordinary skill in the art may recognize alternative embodiments of the spherical member 401. In such an embodiment, the magnetic field produced by the magnetic spherical member 401 may interact with the receiving member 402 holding the spherical member 401 in place relative to the receiving member 402.

In other embodiments, the receiving member 4002 may be magnetic, and the spherical member 401 may be held in place by the magnetic field produced by the receiving member 402. In still further embodiments, both the spherical member 401 and the receiving member 402 may be magnetic.

FIG. 5 is a side view illustrating the spherical member 401 and receiving member 402 of the textile fastener 400 in a pegged configuration. As illustrated, the spherical member 401 may be received through the opening of the receiving member 402. As illustrated, once inserted into the opening of the receiving member 402, the spherical member 401 may protrude partially from both sides of the receiving member 402.

FIG. 6 is a cross-section view illustrating how the pegged configuration of FIGS. 4 and 5 may be used for clasping or pegging a textile 600 between the spherical member 401 and the receiving member 402 so that the textile fastener may be fastened to textile 600. The textile 600 has a first side 601 and a second side 602. In one embodiment, a portion of the textile 600 may be placed over the opening 603 of the receiving member 604. The first side 601 of the textile 600 may be placed adjacent to the surface 605 of the receiving member 604. The spherical member 606 may be placed adjacent to the second side 602 of the textile 600 and inserted into the opening 603 of the receiving member 604. In such an embodiment, a friction force may be exerted on the textile 600 by the pinching or pegging of the textile 600 between the spherical member 606 and the receiving member 604. The friction force may be maintained by the magnetic interaction between the spherical member 606 and the receiving member 604, where at least one of the two members is magnetic.

FIG. 7 is a cross-section view illustrating a textile fastener having a spherical member 701 and a receiving member 702 configured to fasten two textile layers. The depicted embodiment illustrates a first layer 703 of textile and a second layer 704 of textile. In one embedment, the first layer 701 may be placed over the second layer 702. Either the first layer 703 or the second layer 704 may be placed adjacent the opening in receiving member 702. The spherical member 701 may then be inserted into the opening thereby pegging both the first layer 703 and the second layer 704 between the spherical member 701 and the receiving member 702.

FIG. 8 is a cross-section view illustrating a spherical member 801 and a receiving member 802 of one embodiment of a textile fastener 800 having a protective coating 804. In one embodiment, a protective coating 803 may be formed around the spherical member 801. In another embodiment, the protective coating 804 may be formed around the receiving member 802. In the embodiment illustrated in FIG. 8, the protective coatings 802, 803 may be the same or different materials. The protective coatings 803, 804 may include a material that is configured to enhance the grip or friction force between the textile layer (not shown), the spherical member 801, and the receiving member 802. The protective coatings 803, 804 may include, for example, rubber, plastic, or other substance that would cause no damage to the textile. The protective coatings 803, 804 may be selected so as to not inhibit the magnetic interaction between the spherical member 801 and the receiving member 802. In other embodiments, the surface of the spherical member 801 and/or the surface of the receiving member 802 may be roughened to promote adhesion to or friction against a textile.

FIG. 9 is a cross-section diagram illustrating an embodiment of a textile fastener 900 including a spherical member 901, a receiving member 902, and a cover member 903 having an outer assembly 904 joined with an inner assembly 905. The cover member 903 provides a structure that partially or completely conceals the textile fastener from view. For explanatory purposes, FIG. 9 illustrates the outer assembly 904 and the inner assembly 905 are un-joined. In actual use, outer assembly 904 and inner assembly 905 may be permanently or temporarily attached. In alternative embodiments, cover member 903 may be a single piece having the overall shape of the combined outer assembly 904 and inner assembly 905.

In order to conceal spherical member 901 and receiving member 902, the embodiment illustrated in FIG. 9 utilizes cover member 903, which has a dome-shaped outer assembly 904 joined with an inner assembly 905. The cover member 903 is mated to the spherical member 901 and receiving member 902 via magnetic attraction. Inner assembly 904 is configured with a shape that corresponds to the combined spherical member 901 and receiving member 902. Inner assembly 903 is comprised of a magnetized or ferromagnetic material that is attracted to the magnetic field of the spherical member 901. This magnetic attraction serves to secure the cover member 903 to the spherical member 901 approximately over the center of the coupled spherical member 901 and receiving member 902, thus concealing both the spherical member 901 and the receiving member 902 of the textile fastener substantially from view.

The outer assembly 904 of the cover member 903 serves to conceal the remaining components of the textile fastener. In the embodiment illustrated in FIG. 9, the outer assembly 904 is a dome-shaped structure with an outer diameter that is greater than the widest diameter of the receiving member 902, the spherical member 901 and the inner assembly 905 of the cover member 903. Configured in this manner, once the cover member 903 is mated to the spherical member 901, the outer assembly 904 serves to substantially conceal from view all other components of the textile fastener.

In various embodiments, the outer assembly 904 of a cover member is made of a non-magnetic material that has either a negligible or complete lack of a magnetic field. In some scenarios, the textile fastener will be used to secure articles of clothing in place. In other scenarios, the textile fastener will be used to attach ornamental and/or functional accessories to clothing. In many of these cases, a portion of the textile fastener will be exposed on an outermost layer of clothing. In other scenarios, the textile fastener will be used to secure cloth layers associated with household furnishings or decorations, such as window, furniture or walls coverings. In these and other scenarios, it is desirable for the textile fastener to produce a minimal magnetic field. A textile fastener with an outer portion 904 that is non-magnetic is desirable in many such scenarios where the textile fastener could possible come in close proximity with metallic and ferromagnetic objects that would be affected by a magnetic field emitted from the outer assembly of the cover member. Consequently, the outer assembly 904 of a cover member 90 may be constructed with a non-magnetic material that has little or no magnetic properties and serves to provide a physical shield from the magnetic component(s) of the textile fastener such that metallic objects that come in proximity to the textile fastener are not subject to unwanted magnetic attraction or repulsion to the textile fastener. One of ordinary skill in the art will recognize that a variety of non-magnetic materials, such as wood or other non-metallic materials or non-ferrous metals, may be suitable for use in forming the outer assembly of the cover member in accordance with some embodiments.

FIG. 10 is a cross-section view of an embodiment of a textile fastener having a cover member 1001 comprised of a joined outer assembly 1002 and inner assembly 1003. FIG. 10 further illustrates the mating of the cover member 1001 with the spherical member 1004 via magnetic attraction between the inner assembly 1003 and the spherical member 1004.

The spherical member 1004 and the receiving member 1005 are coupled via magnetic interaction to create a friction force that secures the textile fastener to one or more layers of textile 1006. The friction force pinches or pegs the layer of textile 1006 in the opening of the receiving member 1005 and results from the magnetic attractive of the spherical member 1004 towards the center of the opening of the receiving member 1005. If multiple layers of textile are secured, the receiving member 202 and the spherical member 201 are coupled in the same fashion by pinching or pegging the layers of textile in the opening of the receiving member by the force exerted by the spherical member. By being secured to multiple layers of textile at once, the textile fastener 1000 prevents relative movement of the multiple layers at the point of coupling of the textile fastener 1000 to the secured multiple layers. FIG. 10 further illustrates the joined outer assembly 1002 and inner assembly 1003 of the cover member, with the cover member concealing the spherical member 1004 and the receiving member 1005 from view.

FIG. 11 illustrates top and bottom views of the textile fastener. One of ordinary skill in the art will recognize that various mechanism may be used for joining the outer assembly 1101 and the inner assembly 1102 to form a cover member of a textile fastener in accordance with the present embodiments. For example, the outer assembly 1101 may be glued, soldered, welded, stamped, or otherwise coupled to the inner assembly 1102. In a further embodiment, the inner assembly 1102 may be integral with the outer assembly 1101 to form a cover member that is a single component.

FIG. 12 illustrates another embodiment of a textile fastener that is configured to provide an improved mating between the inner assembly 1202 of cover member 1201 and the spherical member 1203. As described above, according to various embodiments, an inner assembly 1202 is shaped to conform to the shape of the coupled spherical member 1203 and receiving member 1204. In the embodiment of the FIG. 12, the inner assembly 1202 includes a dome-shaped indentation 1205 that corresponds to the spherical shape of the spherical member 1203. In some embodiments, the magnetic force exerted by the spherical member 1203 on the inner assembly 1202 may be relatively strong such that, once mated, the magnetic force holding inner assembly 1202 to the spherical member 1203 may be difficult to overcome, such that the cover member 1201 may be difficult to pull apart from the spherical member 1203 thereby preventing accidental removal of cover member 1201.

Although the example embodiment illustrated in FIG. 12 shows the cover member 1201 in direct or nearly direct contact with spherical member 1203, it will be understood that the cover member 1201 may be attached on the opposite side of the textile fastener so that textile 1206 is between cover member 1201 and spherical member 1203. In such a configuration, the curvature of dome-shaped indentation 1205 may be selected to follow the curvature of spherical member 1203 and to allow sufficient room to accept textile 1206 between these components. In various embodiments, the surface of indentation 1205 may be adapted to fit spherical member 1203 exactly (i.e., both having approximately the same radius) or indentation 1205 may have a slightly larger radius than spherical member 1203 so that a space is formed between the indentation 1205 and the spherical member 1203. Such a space may be sized to accept one or more layers of textile or fabric between the indentation 1205 and the spherical member 1203.

The outer assembly of the cover member in the embodiments illustrated in FIGS. 9-12 is an unadorned dome-shaped structure. In this embodiment, the outer assembly provides its basic function, which is to substantially conceal the other components of the textile fastener from view. In other embodiments, the outer assembly may be more ornamental and/or functional in nature, while still substantially concealing the other components of the textile fastener from view. In the embodiment illustrated in FIG. 13, the outer assembly 1301 includes a central, dome-shaped structure 1302 that is adapted to receive a spherical member of a textile fastener. The outer assembly 1301 of FIG. 13 also includes a decorative component 1303 that resembles, for example, a wreath that is inlaid with gemstones. Together, the dome-shaped structure 1302 and the decorative component 1303 comprise an outer assembly 1301 of a cover member that may be used to create a textile fastener that serves as a clothing accessory, such as a brooch, clasp or other pin that serves an ornamental and/or functional purpose. The cover member has an inner assembly 1304 that provides a magnetic connection to a spherical member of a textile fastener. In other embodiments, dome-shaped structure 1302 may be removed so that an underlying textile is exposed.

FIG. 14 illustrates another embodiment of a textile fastener 1401 with a different decorative component 1402 of the outer assembly. The embodiment of FIG. 14 also includes a central, dome-shaped structure 1403 from which the decorative component 1402 extends. The embodiment of FIG. 14 utilizes a design for the decorate portion that includes gemstones inlaid in a non-magnetic material and further including decorative voids. In some embodiments, designs may incorporate actual gems and/or precious metals. Other embodiments may utilize any variety of less costly materials. In other embodiments, dome-shaped structure 1403 may be removed so that an underlying textile is exposed.

One of ordinary skill in the art will recognize that a wide variety of designs may be used for the decorative components of textile fasteners similar to those provided in the embodiments of FIGS. 13 and 14. Merely by way of example, in the embodiments of both FIGS. 13 and 14, the outer assemblies are formed by a central dome-shaped structure and an outer decorative portion. In some embodiments, no distinct decorative portion and separate outer portion may be present. Embodiments may utilize any ornamental design for an outer assembly that serves to reasonably conceal the inner assembly, spherical member and the receiving member of the textile fastener. Embodiments may utilize outer assemblies that range from expensive jewelry to costume jewelry to whimsical applications.

FIG. 15 is a top view diagram illustrating an additional embodiment of a textile fastener 150. In the depicted embodiment, the textile fastener 150 includes two receiving members 151 and 152 and a pegging member 153. In one embodiment, the receiving members 151 and 152 are magnetic. In other embodiments the pegging member 153 may be magnetic. In further embodiments, both the receiving members 151 and 152 and the pegging member 153 are magnetic. Alternatively, only one of the pegging member 153 or the receiving members 151 and 152 is magnetic. In such embodiments, the non-magnetic member comprises a magnetically reactive material, such as iron or other ferrous material. For example, if the pegging member 153 is magnetic, one or both of the receiving members 151 and 152 may have a steel or iron component. If the one or both of the receiving members 151 or 152 is magnetic, then the pegging member 153 may be reactive to magnetic fields, and so on. One of ordinary skill in the art will recognize a variety of magnetic materials that may be suitable for use with the present embodiments. In one embodiment, strong permanent magnets made from alloys of rare earth elements are used. Similarly, one of ordinary skill in the art will recognize a variety of materials that are reactive to magnetic fields that may be suitable for use with the present embodiments.

The receiving members 151 and 152 and the pegging member 153 may each be configured in various shapes and arrangements. For example, the receiving members 151 and 152 may be disks as illustrated in FIG. 15. The receiving members 151 and 152 may include openings 154, 155 in the disk as shown in FIG. 15. The openings 154, 155 may be a hole passing completely through the surface 156, 157 of the disk. Alternatively, the openings 154, 155 may be a concave recess in the surfaces 156, 157 of the disk. In such embodiments, the pegging member 153 may be a sphere or cylinder configured to fit through the openings 154, 155. In a particular embodiment, the diameter of the pegging member 153 may be slightly smaller than the diameter of the openings 154, 155, thus allowing space for one or more layers of a textile between edges of the openings 154, 155 and a surface of the pegging member 153.

FIG. 16 is a side view diagram illustrating one embodiment of a textile fastener 150 in a pegged configuration. As illustrated, the pegging member 153 may be received through the openings of the receiving members 151 and 152. In one embodiment, the pegging member 153 may protrude partially from the sides of the receiving members 151 and 152. The receiving members may have any appropriate shape, such as a disk, ring, hoop, or donut shape, as long as the openings in the receiving members are adapted to accept a corresponding pegging member. Some or all of the receiving members and the pegging member may have a metallic color or may be painted, stained, coated, or embossed with any ornamental color, pattern, design, or image. In one embodiment, the fastener comprises rings and a magnetic ball that are made of nickel-coated steel.

FIG. 17 is a side view diagram illustrating an alternative embodiment of a textile fastener. As illustrated, a spherical pegging member 171 is combined with ring-shaped receiving members 172, 173. The ring-shaped receiving members 172, 173 have central holes that the spherical pegging member 171. In one embodiment, the holes in the receiving members 172, 173 have a smaller diameter than the diameter of the spherical pegging member 171. In such embodiments, the spherical pegging member 171 cannot pass complete through either the receiving member 172 or 173.

FIG. 18 is a cross-section view illustrating a textile fastener configured to fasten two textile layers. The depicted embodiment illustrates a first textile layer 181 and a second textile layer 182. The first textile layer 181 is placed adjacent to receiving member 172. The pegging member 171 may then be positioned on the opposite side of first textile layer 181 and into the opening of receiving member 172 thereby pegging the first textile layer 181 between the pegging member 171 and the receiving member 172.

Similarly, the second textile layer 182 is positioned adjacent to receiving member 173. The pegging member 171 may then be positioned on the opposite side of second textile layer 182 and into the opening of receiving member 173 thereby pegging the second textile layer 182 between the pegging member 171 and the receiving member 173. This has the effect of holding the two textile layers 181, 182 in a fixed position relative to each other.

The two textile layers 181 and 182 may be the same or different types of materials. The two textile layers 181 and 182 may be part of the same or different articles. For example, the two textile layers 181 and 182 may be different sections of a scarf, shawl, wrap, curtain, or sheet. Alternatively, the two textile layers 181 and 182 may be different articles, such as a tie held position on a shirt, or a scarf held in position on a jacket.

Embodiments may be used for functional applications such as securing a nametag to an article of clothing without requiring the wearer to use pins, without requiring piercing holes in the article of clothing or textile, and without requiring a clothing surface that is particularly selected or suitable for using an attachment mechanism, such as an alligator clip or similar spring clip. Similarly, embodiments may be used applications such as securing a microphone, activity tracker or other wearable electronics component to an article of clothing, again without requiring the use of pins or clips. Embodiments utilized for electronics applications may include shielding to protect the electronics from the magnetic field generated by the magnetic component(s) of the textile fastener.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

What is claimed is:

1. A textile fastener, comprising:

a single spherical member having a spherical diameter;

a first receiving member, the first receiving member comprising:

a first ring portion; and a first opening extending through the first ring portion, wherein the first opening is circular and has a first inner diameter that is smaller than the spherical diameter, and wherein the first opening receives a first textile and the single spherical member so that the single spherical member applies a force between the first textile and the first receiving member, and wherein magnetic interaction between the single spherical member and the first receiving member maintains at least a portion of the force between the first textile and the first receiving member; and a second receiving member comprising:

a second ring portion; and a second opening extending through the second ring portion, wherein the second opening is circular and has a second inner diameter that is smaller than the spherical diameter, and wherein the second opening receives a second textile and the single spherical member so that the single spherical member applies a force to hold the second receiving member against the second textile, and wherein magnetic interaction between the single spherical member and the second receiving member maintains at least a portion of the force between the second textile and the second receiving member.

2. The textile fastener of claim 1, wherein the first textile and the second textile are different sections of a same article.

3. The textile fastener of claim 1, wherein the first textile and the second textile comprise different articles.

4. The textile fastener of claim 1, wherein at least one of the first and second textiles comprises multiple layers of materials.

5. The textile fastener of claim 1, wherein one or both of the receiving members are magnetic.

6. The textile fastener of claim 1, wherein one or both of the receiving members are comprised of a non-magnetic material.

7. The textile fastener of claim 1, wherein the single spherical member is magnetic.

8. The textile fastener of claim 1, wherein the single spherical member is comprised of a non-magnetic material.

9. A textile fastener comprising:

a single spherical member having a spherical diameter;

a first receiving member, the first receiving member comprising:

a first surface portion; and a first opening, wherein the first opening is circular and has a first inner diameter that is larger than the spherical diameter, and wherein the first opening receives a first textile and the single spherical member so that the single spherical member applies a force against the first textile and the first receiving member when the single spherical member is inserted into the first opening thereby inhibiting movement of the first textile relative to the single spherical member, and wherein magnetic interaction between the single spherical member and the first receiving member maintains at least a portion of the force between the first textile and the first receiving member; and a second receiving member comprising:

a second surface portion; and a second opening, wherein the second opening is circular and has a second inner diameter that is larger than the spherical diameter, and wherein the second opening receives a second textile and the single spherical member so that the single spherical member applies a force against the second textile and the second receiving member when the single spherical member is inserted into the second opening thereby inhibiting movement of the second textile relative to the single spherical member, and wherein magnetic interaction between the single spherical member and the second receiving member maintains at least a portion of the force between the second textile and the second receiving member.

10. The textile fastener of claim 9, wherein the first textile and the second textile are different sections of a same article.

11. The textile fastener of claim 9, wherein the first textile and the second textile comprise different articles.

12. The textile fastener of claim 9, wherein at least one of the first and second textiles comprises multiple layers of materials.

13. The textile fastener of claim 9, wherein one or both of the receiving members are magnetic.

14. The textile fastener of claim 9, wherein one or both of the receiving members are comprised of a non-magnetic material.

15. The textile fastener of claim 9, wherein the single spherical member is magnetic.

16. The textile fastener of claim 9, wherein the single spherical member is comprised of a non-magnetic material.

17. The textile fastener of claim 9, wherein one or both of the first receiving member and the second receiving member are disk-shaped.

18. The textile fastener of claim 9, wherein one or both of the first receiving member and the second receiving member are hoop-shaped.

* * * * *